US005967648A

United States Patent [19]

Barnes, II et al.

[11] Patent Number: 5,967,648

[45] Date of Patent: Oct. 19, 1999

[54] LIGHTING FIXTURE INCLUDING A NEUTRAL DENSITY POLYMERIC MATERIAL FOR CONTROLLED LIGHT DISTRIBUTION

[75] Inventors: Thomas F. Barnes, II; Joel E. Robinson; Dale A. Troppman, all of Charlevoix, Mich.

[73] Assignee: Lexalite International Corporation, Charlevoix, Mich.

[21] Appl. No.: 09/020,817

[22] Filed: Feb. 9, 1998

[51] Int. Cl.[6] ..... F21V 7/00

[52] U.S. Cl. ..... 362/307; 362/223; 362/311

[58] Field of Search ..... 362/223, 224, 362/311, 327, 351, 307

[56] References Cited

U.S. PATENT DOCUMENTS

| | | | |
|---|---|---|---|
| 3,284,625 | 11/1966 | Barnes . | |
| 4,380,794 | 4/1983 | Lawson | 362/296 |
| 4,573,111 | 2/1986 | Herst et al. | 362/337 |
| 4,751,626 | 6/1988 | Plewman | 362/346 |
| 4,833,575 | 5/1989 | Hamilton | 362/223 |
| 4,866,584 | 9/1989 | Plewman | 362/225 |
| 4,903,180 | 2/1990 | Taylor et al. | 362/337 |
| 4,907,143 | 3/1990 | Lasker | 362/225 |
| 4,971,847 | 11/1990 | Freed | 428/36.7 |
| 5,143,446 | 9/1992 | Barnes et al. | 362/293 |
| 5,481,445 | 1/1996 | Sitzema et al. | 362/308 |

OTHER PUBLICATIONS

Brochure entitled "Columbia Lighting Product Announcement", Columbia Lighting, no date given.

Brochure entitled "Optika", Precision Architectural Lighting, no date given.

Brochure entitled "The First Name In Task Lighting Is Now Your Best Choice In Ambient/Indirect Lighting", Luxo Corporation, no date given.

Brochure entitled "Looks Aren't Everything They're Just The Beginning With Avalon", Columbia Architectural, no date given.

Brochure entitled "SoftLite 46P", Linear Lighting Corp., Copyright 1995 by Linear Lighting Corp, 1995.

*Primary Examiner*—Stephen Husar

*Attorney, Agent, or Firm*—Mason, Kolehmainen, Rathburn & Wyss; Joan Pennington

[57] ABSTRACT

A luminaire having both a direct and indirect lighting component is provided. The luminaire includes a fixture including a lamp. A neutral density polymeric material is disposed below the lamp. The neutral density polymeric material includes a polymeric substrate carrying a predetermined pattern for reflecting and transmitting incident light from the lamp.

14 Claims, 4 Drawing Sheets

LIGHTING FIXTURE INCLUDING A NEUTRAL DENSITY POLYMERIC MATERIAL FOR CONTROLLED LIGHT DISTRIBUTION

FIELD OF THE INVENTION

The present invention relates to lighting fixtures and luminaires, and more particularly to improvements in lighting fixtures and luminaires having both a direct and indirect component.

DESCRIPTION OF THE PRIOR ART

Direct/indirect lighting has acquired increasing popularity as a mechanism for providing glare-free, uniform lighting for building interiors. Achieving uniformity in the visible field is of paramount importance to an effective lighting system. Suspended direct/indirect luminaires must themselves blend into the visible field by approximating the brightness of the ceiling above them, through all viewing angles. Initially this was attempted by painting the luminaires white, however as no direct illumination was incident on the exterior surface, they still appeared darker than the surrounding area. Later, perforated metals were employed to allow a portion of the light to leak through the fixture, approximating neutral density. A problem with perforated metal is the brightness of the unobscured lamp through the perforations. This was improved by inserting a translucent white polymeric sheet on the lamp side of the perforated metal. Also a flat translucent acrylic panel with a silk-screened perforated pattern on the exterior surface has been provided with direct/indirect luminaires. While the above described arrangements have generally provided neutral density, this has been accomplished at the expense of fixture efficiency, light control and cost.

SUMMARY OF THE INVENTION

A principal object of the present invention is to provide an improved direct/indirect luminaire overcoming many of the disadvantages of known arrangements.

In brief, a luminaire having both a direct and indirect lighting component is provided. The luminaire includes a fixture including a lamp. A neutral density polymeric material is disposed below the lamp. The neutral density polymeric material includes a polymeric substrate carrying a predetermined pattern for reflecting and transmitting incident light from the lamp.

BRIEF DESCRIPTION OF THE DRAWING

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
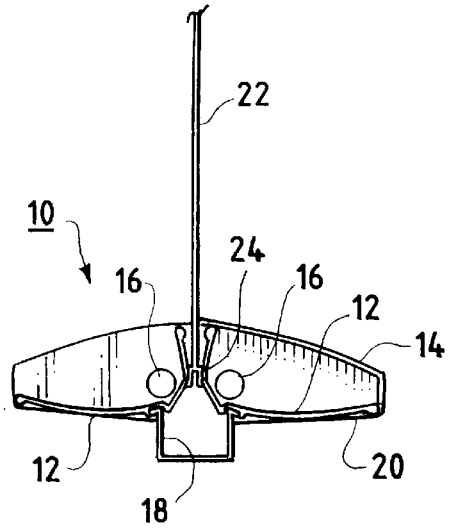
FIG. 1 is an end elevational view of a direct/indirect luminaire in accordance with the present invention.

Having reference now to the drawings, in FIG. 1, an improved lighting fixture or luminaire having both a direct and indirect component is generally designated by 10 employing a neutral density polymeric material generally designated as 12 in accordance with features of the invention. The neutral density polymeric material 12 has an inside and/or an outside surface with a pattern including a plurality of shapes, such as dots, squares, and the like which may be either highly reflective or permit efficient transmission of incident light rays. The pattern, frequency, size and reflectivity of the shapes is specifically tailored to the application such that the fixture 10 has approximately the same apparent brightness as its background.

The lighting fixture or luminaire 10 includes a cover 14 surrounding a pair of lamps 16, such as fluorescent tubes that are used together with a ballast 18. The luminaire 10 includes a pair of end caps 20. The luminaire 10 is supported by a cord 22 and a mounting bracket 24.

Figure 2:
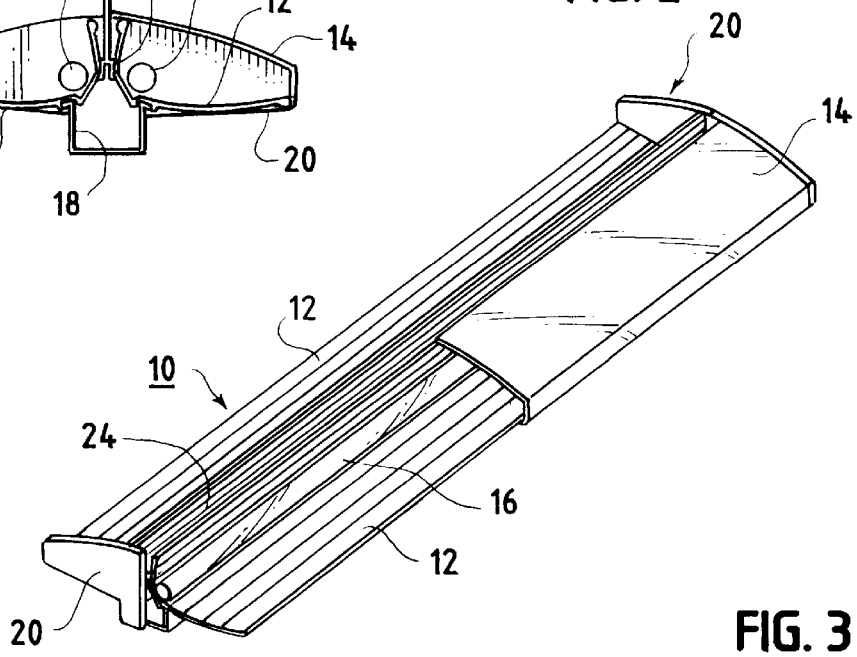
FIG. 2 is a perspective view of the direct/indirect luminaire of FIG. 1 in accordance with the present invention with portions broken away to illustrate interior components.
Figure 3:
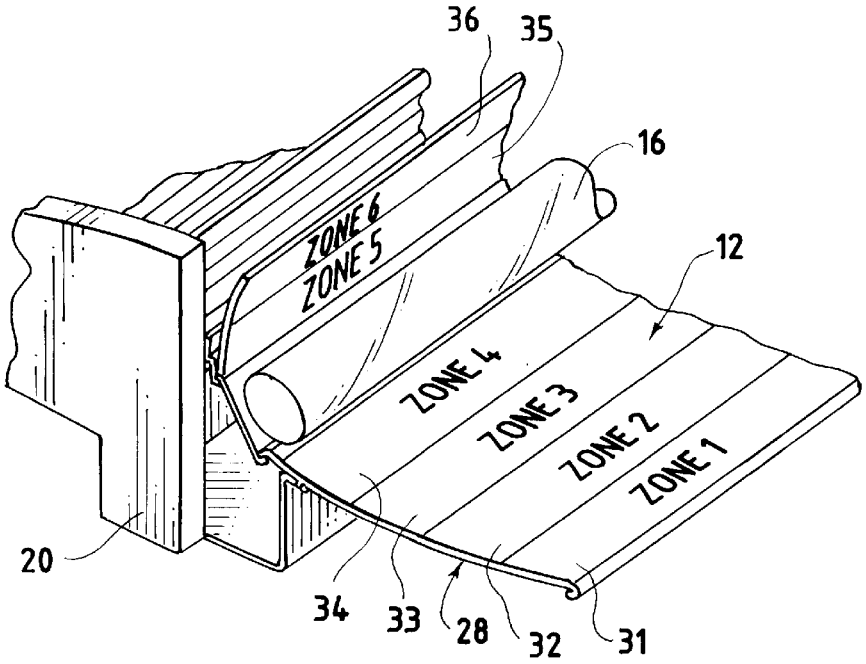
FIG. 3 is a detailed view of a fragmentary portion of FIG. 2 in accordance with the present invention.

Referring also to FIGS. 2 and 3, the neutral density polymeric material 12 employed in the lighting fixture or luminaire 10 may include multiple zones 1–5, 31, 32, 33, 34, 35, and 36. Each of the multiple zones 1–5, 31, 32, 33, 34, 35, and 36 can include a separate pattern, such as one of the patterns shown in FIGS. 4, 5, and 6, to provide a desired overall light distribution.

Problems in conventional arrangements are overcome in the present invention because the neutral density polymeric material 12 accomplishes the reflection and transmission functions of the fixture with greater efficiency, better optical control and lower cost. In one version of the invention, that portion of the light being reflected does so in a specular manner and with efficiencies exceeding 85%. That portion of the light being transmitted, does so in a diffuse manner and with efficiencies exceeding 81%. Due to the specular nature of the reflective material 12 and the shape of the reflector/housing 14, the fixture 10 produces a narrow, wide spread beam pattern necessary for uniformity over a wide spacing. Due to the nature of the neutral density polymeric material 12, the transmitted light is delivered efficiently and with appropriate diffusion of the lamp image.

Figure 4:
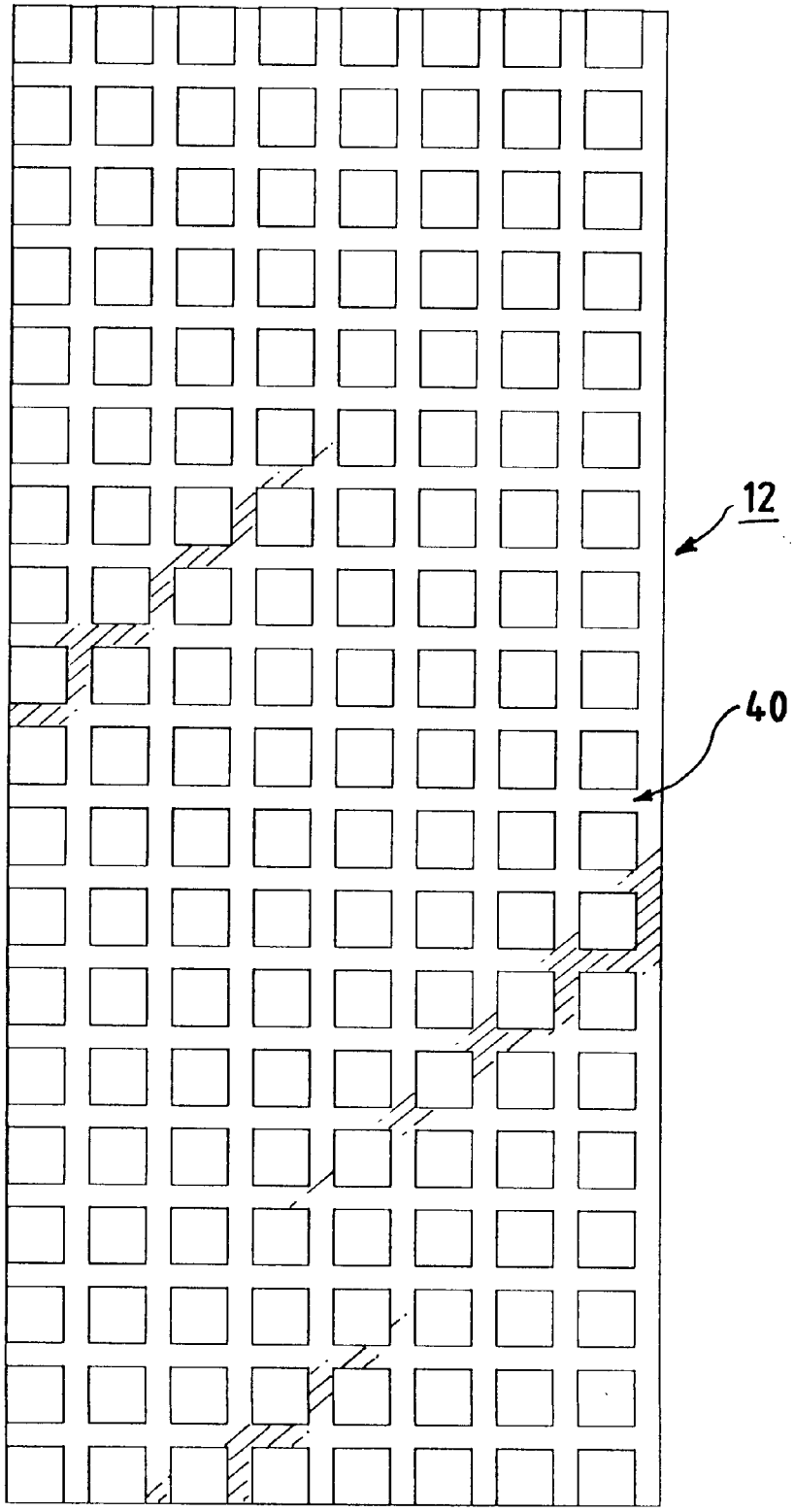
FIGS. 4, 5 and 6 are plan views illustrating alternative patterns carried by a neutral density polymeric material in accordance with the present invention.
Figure 5:
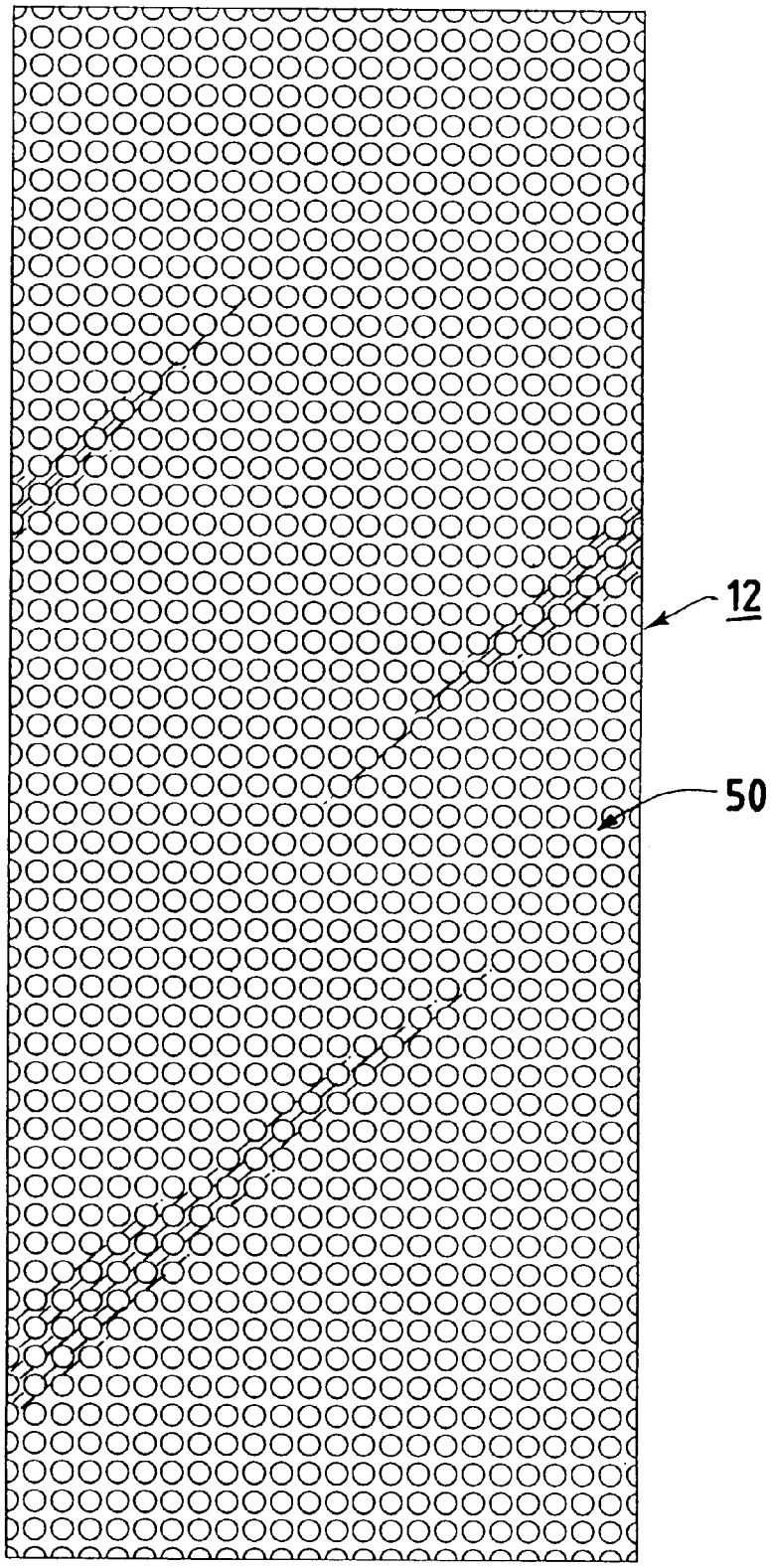
Figure 6:
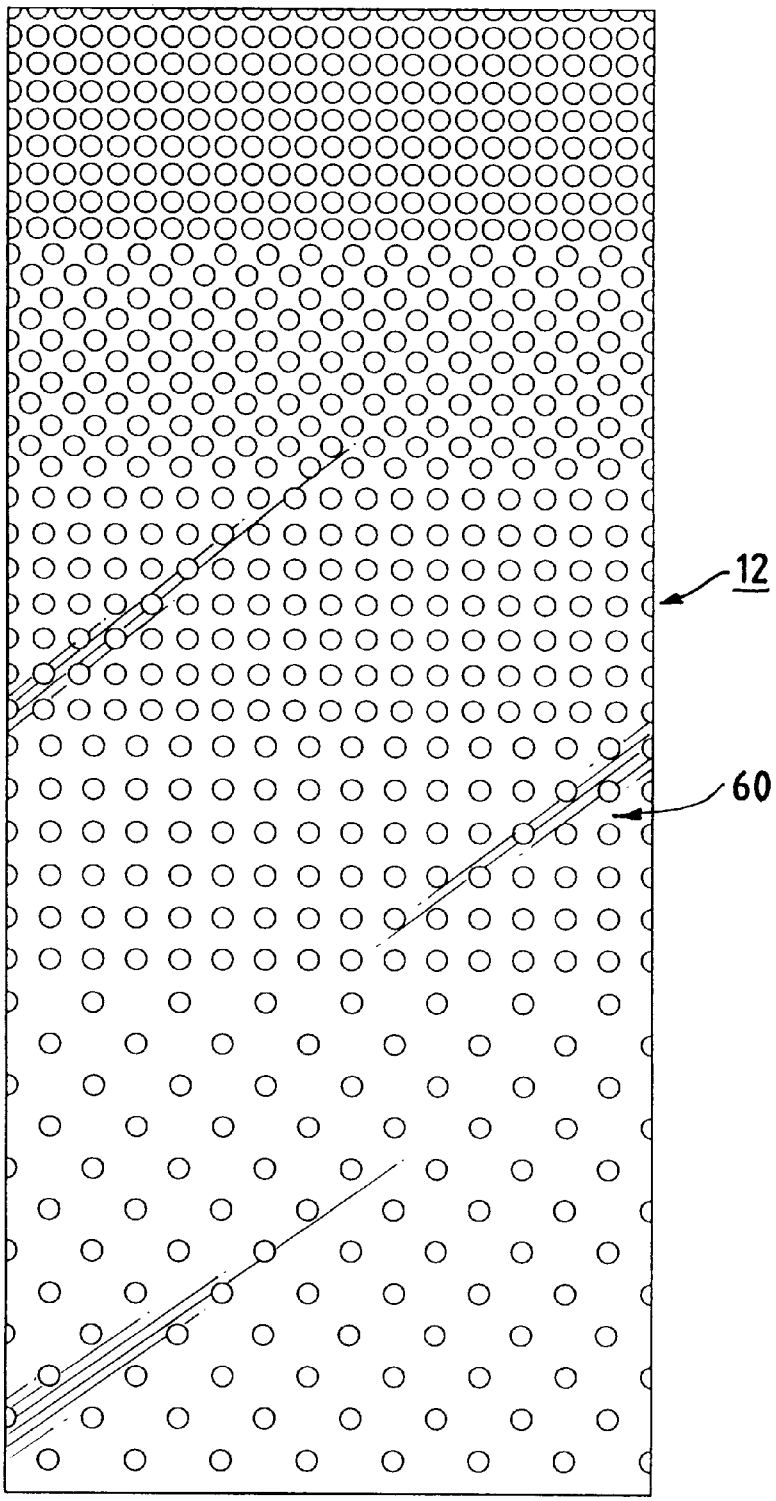

The neutral density polymeric material 12 consists of a polymeric substrate 28 shown in FIG. 3, that is translucent or transparent with a pattern of reflective and/or translucent and/or transparent media disposed directly on one surface of the substrate 28. A pattern, for example, as shown in FIGS. 4, 5, and 6 can be formed or applied on either an inside or outside surface of the polymeric substrate 28. Alternatively, a pattern can be part of a separate film (not shown) disposed adjacent to or permanently adhered to the inside and/or outside surface of substrate 28. The patterns on the material 12 provide substantially neutral density for the fixture 10. Patterns may be generally uniform, for example, as shown in FIGS. 4 and 5, or may include a gradient dot pattern, as shown in FIG. 6, as required to provide neutral density.

The neutral density polymeric material 12 can be made from a heat transfer film with a specular perforation pattern applied over or adhered to a clear structural substrate, such as 0.100" thick acrylic, polycarbonate or other polymeric substrate. When the heat transfer film is removed, the pattern remains on the acrylic or polycarbonate substrate. The features of this film include: a specular first surface providing approximately 50% reflection, suitable for good light control and a diffuse substrate which provides sufficient hiding power to substantially reduce the lamp image, while maintaining efficient transmission.

Also the neutral density polymeric material 12 can be made from an acrylic, polycarbonate or other polymeric film, which is metallized with aluminum, silver or other reflective material. The metallization can have a predetermined pattern or can have a pattern later etched into it. The film is applied to an acrylic, polycarbonate or other polymeric substrate. The film may have a pressure sensitive adhesive applied on its surface to be bonded to the substrate. Alternatively, the film may be adhered to the substrate by heating the substrate and/or the film and applying pressure. The features of this film can include a protective first surface and substrate for withstanding normal cleaning and UV radiation, a specular, semi-specular or other highly reflective patterned second surface providing a desirable ratio of reflection and transmission such as within the range of 90% reflected/10% transmitted to 30% reflected/70% transmitted. The film may also include a diffusing feature either as a result of a texture or additive such as $TiO_2$.

Referring to FIG. 4, the neutral density polymeric material 12 is shown with a square dot pattern generally designated by 40 providing about 45% light transmission.

Referring to FIG. 5, the neutral density polymeric material 12 is shown with a consistent circular dot pattern generally designated by 50 providing about 50% light transmission.

Referring to FIG. 6, the neutral density polymeric material 12 is shown with a gradient, circular dot pattern generally designated by 60 providing variable light transmission.

While the present invention has been described with reference to the details of the embodiments of the invention shown in the drawing, these details are not intended to limit the scope of the invention as claimed in the appended claims.

What is claimed is:

1. A luminaire having both a direct and indirect lighting component comprising:

a fixture including a lamp;

a neutral density polymeric material disposed below said lamp, said neutral density polymeric material including a polymeric substrate carrying a predetermined pattern for reflecting and transmitting incident light from said lamp.

2. A luminaire as recited in claim 1, wherein said neutral density polymeric material includes a plurality of zones, each zone providing a selected light transmission.

3. A luminaire as recited in claim 1, wherein said neutral density polymeric material includes said predetermined pattern of a square dot pattern.

4. A luminaire as recited in claim 1, wherein said neutral density polymeric material includes said predetermined pattern of a circular dot pattern.

5. A luminaire as recited in claim 1, wherein said neutral density polymeric material includes said predetermined pattern of a variable dot pattern.

6. A luminaire as recited in claim 1, wherein said polymeric substrate of neutral density polymeric material is transparent.

7. A luminaire as recited in claim 1, wherein said polymeric substrate of neutral density polymeric material is translucent.

8. A structure used with a luminaire including a light source and having both a direct and indirect lighting component, said structure comprising:

a neutral density polymeric material disposed below the light source, and said neutral density polymeric material including a polymeric substrate carrying a predetermined pattern for reflecting and transmitting incident light from said lamp.

9. A structure used with a luminaire as recited in claim 8, wherein said neutral density polymeric material includes a plurality of zones, each zone providing a selected light transmission.

10. A structure used with a luminaire as recited in claim 8, wherein said neutral density polymeric material includes said predetermined pattern of a square dot pattern.

11. A structure used with a luminaire as recited in claim 8, wherein said neutral density polymeric material includes said predetermined pattern of a circular dot pattern.

12. A structure used with a luminaire as recited in claim 8, wherein said neutral density polymeric material includes said predetermined pattern of a variable dot pattern.

13. A structure used with a luminaire as recited in claim 8, wherein said polymeric substrate of neutral density polymeric material is transparent.

14. A structure used with a luminaire as recited in claim 8, wherein said polymeric substrate of neutral density polymeric material is translucent.

* * * * *